United States Patent [19]

Salukvadze

[11] 4,070,130

[45] Jan. 24, 1978

[54] ROTARY CUTTING TOOL

[76] Inventor: Viktor Samsonovich Salukvadze, 5 Parkovaya ulitsa, 42, kv. 53, Moscow, U.S.S.R.

[21] Appl. No.: 711,520

[22] Filed: Aug. 4, 1976

[30] Foreign Application Priority Data

Aug. 4, 1975 U.S.S.R. ..... 2166354

[51] Int. Cl.[2] ..... B26D 1/12

[52] U.S. Cl. ..... 407/31; 407/32; 407/33; 29/79

[58] Field of Search ..... 29/105 R, 79

[56] References Cited

U.S. PATENT DOCUMENTS

| | | | |
|---|---|---|---|
| 1,039,487 | 9/1912 | Casebolt | 29/105 R |
| 1,604,142 | 10/1926 | Andreas | 29/105 R |
| 2,881,507 | 4/1959 | See et al. | 29/105 R |
| 3,557,418 | 1/1971 | Salukvadze | 29/105 R |
| 3,986,543 | 10/1976 | Slayton et al. | 29/105 R |

*Primary Examiner*—Leonidas Vlachos

*Attorney, Agent, or Firm*—Robert E. Burns; Emmanuel J. Lobato; Bruce L. Adams

[57] ABSTRACT

A rotary cutting tool used successfully for machining metal articles, metallic strips, round bars and pipes including descaling, derusting, grinding and polishing. The tool has an arbor with sets of cutting elements in the form of pieces of wire which are compressed and fixed to one another at one end. Secured to the fixed ends across the width of each set there are strips resting on the arbor and fastened to the latter. The free other ends of the cutting elements form the cutting surface of the tool. This construction of the tool allows its use for machining the surfaces of articles of an unlimited width.

5 Claims, 5 Drawing Figures

ROTARY CUTTING TOOL

BACKGROUND OF THE INVENTION

The present invention relates to the tools for machining the surfaces of articles and more particularly it relates to rotary cutting tools, namely needle cutters.

The present invention can be used most successfully for machining metal articles, metallic strips, round bars and pipes, including descaling and derusting, grinding, polishing and other similar operations.

Known in the art at present are rotary cutting tools made in the form of a body of revolution comprising an arbor with sets of cutting elements in the form of pieces of wire which are fixed together at one end and pressed against one another by their side surfaces in close proximity to the fixed ends while their free ends form the cutting surface of the tool and are spaced so densely that the coefficient of filling of the cutting surface by these ends varies from 0.1 to 0.99.

In these known tools the set of the cutting elements is clamped at the sides by washers and is slipped on a bushing which has a hold-down cover and a key at each end.

Such tools can be made for machining articles up to 500 mm wide because it is quite easy to bore out a bushing to the diameter of the shaft throughout the width of the cutting tool and to make a keyway or splines on the bushing.

However, making a tool wider than 500 mm involves certain technological difficultites, namely:

It is difficult to bore out the bushing to the shaft diameter in very wide tools throughout the width of the tool and to make a keyway or splines in such long bushings.

Besides, considerable radial forces arising in the operating tool may cause the middle part of the set of cutting elements to cave in. Therefore, it becomes necessary to provide stops between the inner surface of the set of cutting elements and the bushing; the stops complicate the design of the tool and make disassembly or assembly of the tool troublesome.

In addition, if some part of the set of cutting elements becomes faulty, it cannot be replaced by a new one since this will be prevented by the bushing and stops.

Owing to the difficulties mentioned above the articles wider than 500 mm are now machined with the aid of mechanisms carrying two or three parallel arbors with cutting tools. One arbor carries two or more tools not wider than 500 mm while the gap between said tools is bridged by some more similar tools mounted on another arbor.

Such mechanisms are rather involved and difficult to operate.

SUMMARY OF THE INVENTION

An object of the present invention is to eliminate the aforesaid disadvantages.

An object of the present invention is to provide a rotary cutting tool in which the sets of cutting elements would allow machining the surfaces of articles of any width.

An important object of the invention is to provide a rotary cutting tool with such sets of cutting elements which would simplify the design of the tool.

Another object of the invention is to provide a rotary cutting tool which would be simple to manufacture, assemble and disassemble.

And still another object of the invention is to provide a tool which would be simple in operation.

These and other objects are achieved by providing a rotary cutting tool for machining the surfaces of articles made in the form of a body of revolution and comprising an arbor with sets of cutting elements in the form of pieces of wire which are fixed together at one end and pressed against one another by their side surfaces in close proximity to the fixed ends while their free ends form the cutting surface of the tool and are spaced so densely that the coefficient of filling of the cutting surface by these ends varies from 0.1 to 0.99 wherein, according to the invention, each set of the cutting elements is provided with strips secured to the fixed ends of the wires, arranged across the width of said set along the rotation axis of the tool, resting on the arbor 6 and having a device for fixing said strips together with the set of the cutting elements on the surface of the arbor. Owing to the provision of the strips and their resting on the arbor the rotary tool can be utilized for machining the surfaces of the articles whose width exceeds 500 mm because in this case the sets of the cutting elements are fixed on the arbor with the aid of the strips and are pressed tightly against one another, forming a common cutting surface consisting of said elements and extending throughout the width of the work.

The total width of the sets placed on the arbor is either equal to or larger than the width of the surface being machined. This excludes the necessity for making and boring out bushings with key or spline grooves.

Besides, the faulty part of the set of the cutting elements can be removed from the arbor and replaced easily and freely by a new one. The fixing device presses tightly the strips complete with the set of cutting elements against the arbor, transmitting the tangential cutting forces to the cutting elements.

BRIEF DESCRIPTION OF THE DRAWINGS

Now the invention will be described in detail by way of example with reference to the accompanying drawings, in which.

DESCRIPTION OF THE PREFERRED EMBODIMENTS

Figure 1:
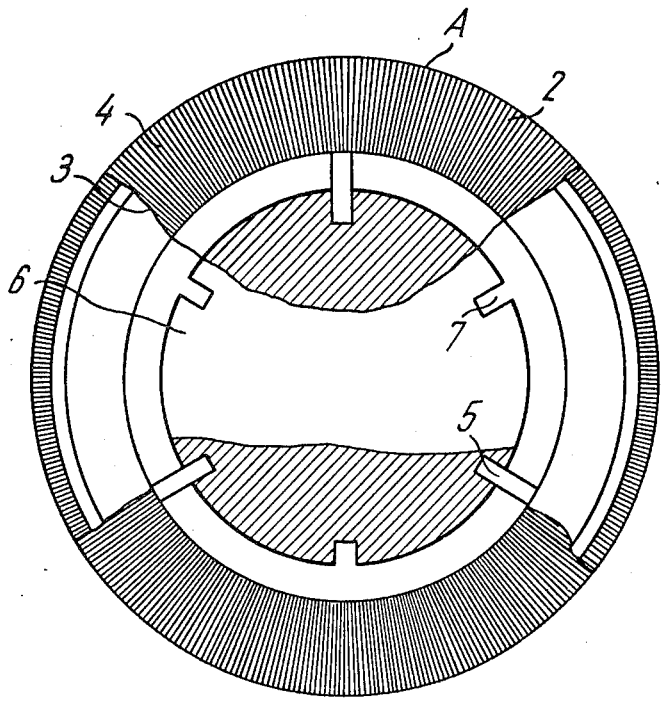
FIG. 1 is an end view of a cutting tool according to the invention, partly in section.
Figure 2:
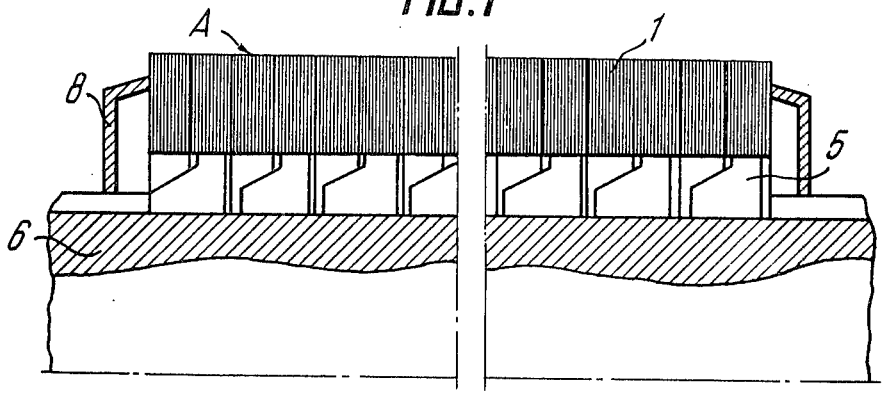
FIG. 2 is a side view of the cutting tool in FIG. 1.

The tool according to the invention is made in the form of a body of revolution and consists of sets 1 (FIGS. 1, 2) of cutting elements 2. The cutting elements are radially arranged in each set and are made of pieces of wire. At one end 3 these elements 2 are fixed together and, pressed against one another by their side surfaces near said ends 3. The other ends 4 of the cutting elements are free and form the cutting surface A of the tool, said free ends being spaced so densely that the coefficient of filling of surface A varies from 0.1 to 0.99.

Figure 3:
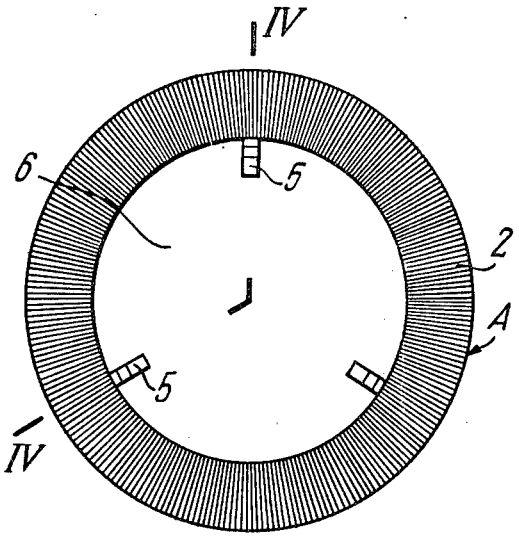
FIG. 3 is a side view of one set of cutting elements with strips.
Figure 4:
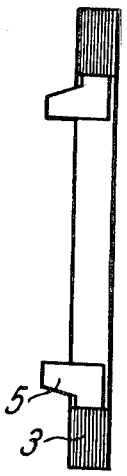
FIG. 4 is a section view taken along section line IV—IV in FIG. 3.

Secured to the fixed ends 3 of the cutting elements 2 across the width of each set 1 are strips 5 arranged along the rotation axis of the tool and resting on the arbor 6. Owing to the provision of the strips 5 the tool may be made up of individual sets of cutting elements to a very large width for machining articles wider than 500 mm. Such a set of elements 2 with strips 5 is shown in FIG. 3, said strips being provided with a device for fixing them, together with the set of elements 2, on the arbor 6. This device consists of slots 7 (FIG. 1) in the arbor 6. The shape of the slots 7 corresponds to the profile of the strips 5 entering said slots. Owing to such positioning of the strips 5 in the slots 7, the cutting elements 2 are subjected to the radial forces pressing them against the machined surface, and to the tangential cutting forces.

Thus, these strips function as a splined or key joint.

The sets 1 of the cutting elements 2 placed on the arbor 6 are held at both ends by covers 8.

Figure 5:
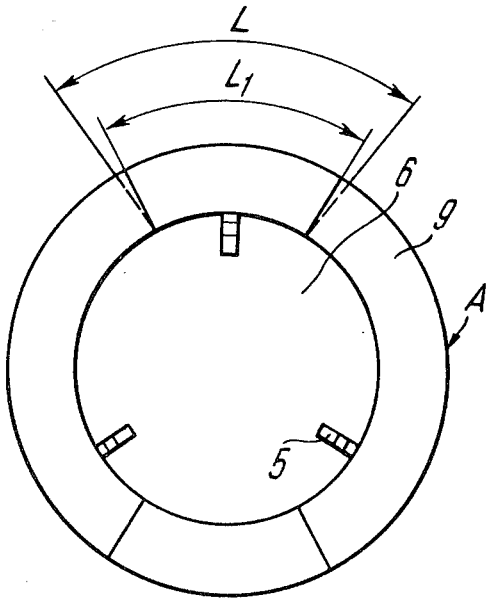
FIG. 5 shows a set of cutting elements composed of individual segments.

Any one set 1 of the cutting elements 2 can be made up of a few segments 9 (FIG. 5), each segment being assembled individually. The length L of the working surface of each segment is larger than its rated length $L_1$ by up to 1/10. This is done in order to ensure the requisite interference between the adjacent segments while gathering them into a set; said interference prevents the formation of clearances on the working surface A of the tool in the cutting direction because such clearances are impermissible in this type of tools. The segments 9 are combined into one set by fastening them to one another consecutively by welding, glueing or by other methods at the side of the ends 3 of the cutting elements 2.

The tool is assembled as follows.

The sets 1 of the cutting elements 2 with the strips 5 fastened to them are placed one after another on the arbor 6. This arbor has slots 7 whose number is 2 – 3 times larger than the number of strips 5 in each set 1 so as to prevent the strips 5 of two adjacent sets from entering one and the same slot 7. This allows the length of the supporting surface of the strip 5 to be made larger than the width of each set. The tool composed of individual sets 1 is compressed from both ends by covers 8.

I claim:

1. A rotary tool comprising, an arbor rotatably driven in use, said arbor having peripheral, axial slots circumferentially spaced angularly, sets of cutting elements comprising arcuate sectors disposed circumferentially of said arbor, each cutting element having mounting means received in said slots for mounting individually said cutting elements in position axially and circumferentially for jointly with similar cutting elements circumferentially enclosing said arbor along an axial length thereof, each said cutting element comprising a plurality of wires each having an end fixed together and an opposite free end, said mounting means of each cutting element being secured to the fixed ends of the corresponding plurality of wires, the free ends of the wires being densely packed and defining a cutting surface.

2. A rotary tool according to claim 1, in which said each set of cutting elements encloses circumferentially said arbor, and said sets of cutting elements extend axially of said arbor and are disposed contiguously in an axial direction and contiguous in a circumferential direction.

3. A rotary cutting tool according to claim 2, including means for maintaining said endmost sets of cutting elements compressed in an axial direction.

4. A rotary cutting tool according to claim 3, in which said mounting means comprise strips each mounting a corresponding plurality of wires thereon, said strips having projections received in said axial slots.

5. A rotary cutting tool according to claim 3, in which the free ends of said wires are densely packed and said surface has a coefficient of filling vary from 0.1 to 0.99.

* * * * *